US006893188B2

(12) United States Patent
Ferrari

(10) Patent No.: US 6,893,188 B2
(45) Date of Patent: May 17, 2005

(54) CONTINUOUS METHOD OF REALIZATION OF WORKS UNDERGROUND, TUNNELS AND EXCAVATIONS IN GENERAL WITH WORKS OF CONSOLIDATION, PERMEABILIZATION AND DRAINAGE OBTAINED THROUGH GUIDED PERFORATIONS

(75) Inventor: Franco Ferrari, La Spezia (IT)

(73) Assignee: Ferrari de Nobili S.R. L., La Spezia (IT)

( * ) Notice: Subject to any disclaimer, the term of this patent is extended or adjusted under 35 U.S.C. 154(b) by 0 days.

(21) Appl. No.: 10/754,078

(22) Filed: Jan. 7, 2004

(65) Prior Publication Data

US 2004/0144003 A1 Jul. 29, 2004

(30) Foreign Application Priority Data

Jan. 24, 2003 (IT) ..... GE2003A0005

(51) Int. Cl.[7] ..... E21D 11/00
(52) U.S. Cl. ..... 405/150.2; 405/152; 405/153
(58) Field of Search ..... 405/132–147, 405/150.2–153, 229, 303, 231–287.1

(56) References Cited

U.S. PATENT DOCUMENTS 3,498,674 A 3/1970 Matthews
5,845,720 A 12/1998 Borjeson et al.
6,234,716 B1 * 5/2001 Chiaves ..... 405/149
6,241,426 B1 * 6/2001 Schellhorn ..... 405/267

FOREIGN PATENT DOCUMENTS

| | | |
|---|---|---|
| DE | 2 320 366 | 11/1974 |
| DE | 34 47 872 | 7/1986 |
| DE | 199 40 774 | 4/2001 |
| EP | 0 291 193 | 11/1988 |
| EP | 0 774 566 | 5/1997 |
| EP | 0 833 011 | 4/1998 |
| JP | 08060976 | 3/1996 |
| JP | 2001082074 | 3/2001 |
| WO | WO 94/25688 | 11/1994 |

* cited by examiner

*Primary Examiner*—Christopher J. Novosad
(74) *Attorney, Agent, or Firm*—Richard M. Goldberg

(57) ABSTRACT

Continuous method of realization of underground tunnels, including the steps of making a plurality of guided perforations of small cross-section around a periphery of an underground tunnel to be realized and extending at least a majority of length of the underground tunnel to be realized, by perforation equipment with a movable perforation head, filling each guided perforation through at least one of reinforcements and aggregating materials to consolidate the tunnel with a resistant arrangement according to precise static conditions, and excavating the tunnel within the filled perforations.

16 Claims, 4 Drawing Sheets

CONTINUOUS METHOD OF REALIZATION OF WORKS UNDERGROUND, TUNNELS AND EXCAVATIONS IN GENERAL WITH WORKS OF CONSOLIDATION, PERMEABILIZATION AND DRAINAGE OBTAINED THROUGH GUIDED PERFORATIONS

BACKGROUND OF THE INVENTION

The technique for the excavation and preparation of tunnels or of underground excavations of any type whatsoever for roads, railways, for canals or underground waterways etc., generally makes use of peripheral consolidation techniques in such way as to create a resistant surrounding for the thrust of the earth during the internal excavation and the final realisation of the work.

Nowadays such known consolidation interventions envisage multiple perforations created around all or part of the external circumference of the tunnel, within which metal, fibreglass or other suitable material reinforcements or inserts are introduced, which are filled with a jet of concrete or other means of consolidation, such as cement mixtures, gel or resins, injected at low or high pressure. These consolidating materials mix with the material present around the periphery of the tunnel being built.

With these known systems crown or umbrella stretches of the consolidated terrain are created, which allow the carrying out in safety of a smooth stretch of excavation of the tunnel. Such a system of execution takes place for further courses of consolidation that are obviously quite short (for example 15–20 m. in length) with resistant veins off axis compared to the tunnel axis, in such way as to be able to act for later stretches of consolidation and relative successive excavation stretches.

The main inconveniences of this known system of proceeding are the following:

- the need for numerous and systematic interventions in making headway, to alternate with excavation operations, with use of the personnel necessarily operating in the tunnel;
- the moving in alternation of the equipment necessary for realisation of the consolidation and excavation at the start and finish of each intervention of consolidation;
- the setting times for the mixtures used for the consolidation and such times are generally lost and are reduced as far as possible to the minimum with possible reduction of the resistance;
- the need for consolidation work on the nucleus of the tunnel being built to sustain the excavation front;
- the need for superimposition of each consolidation intervention compared to the preceding and successive to have guarantees of support for the tunnel front;
- the need to perform the perforations with angles not longitudinal to the tunnel to create the space for the following treatment;
- the excavation of the tunnel with variable sections to compensate with plugging and final works;
- lengthy times for realisation of the work.

In cases in which the consolidation should have to be performed from above on a surface over the tunnel (tunnels with little cover) the difficulties of consolidation, at the current state of the art, are the following:

- the need for perforation in a void to reach the zone inside the tunnel to consolidate;

- the presence of works (sub-services, roads, houses, etc.) existing or to build on the surface;
- costs of expropriation or occupation of public or private areas for execution of the consolidation;
- the numerous movements on impervious bottoms or with poor resistance of the machines useful to realize the consolidation, including injection plant, pumps, etc. and all the structural elements (metal or fibreglass inserts).

Guided perforation systems are also known for tunnels or underground channels of limited cross-section such as sewers, water ducts, channels for electric and telephone cables etc., where said guided perforation takes place by means of equipment with rotating pipes fitted with special perforating heads, such flute shaped heads or hole bottom with asymmetric headed hammers or alternatively with mud turbines, which allow performance of piloted perforations even of considerable length, such as for instance more than 800 m depending on the terrain to cross, with direction that is constantly checked with systems of directional command, such as radio, magnetic, radar, radioactive, with reference to GPS systems or with optical and electronic references, so as to allow at any time the exact location and orientation of the head in the perforation phase.

Perforation may take place with the use of air or fluids under pressure, with destruction or coring bits, with the use of hole bottom hammers, with milling cutters, tricone bits, chisels, mud turbines etc. suitable for correction of the direction of perforation.

The material that results from the perforation discharges between the walls of the drill hole and the drill rod or between the rods and the possible casing, as commonly happens with perforation equipment for wells. The perforation rods that step by step advance within the excavation are then recovered together with the perforation head and during such recovery the possible boring of the hole and the placing of casing takes place with an internal liner in case of drainage or service pipes.

As mentioned, such guided perforation equipment as known nowadays, allows only the perforation of holes or channels of limited cross-section and does not yet permit the excavation of tunnels of considerable or large dimensions, which require consolidation before the excavation operations.

SUMMARY OF THE INVENTION

The purpose of this invention is that of eliminating the inconveniences complained of in regard to the technique used today for the preparation of tunnels or of similar underground works of considerable dimensions and lengths and practically to eliminate the need for successive, intermittent and alternative interventions (consolidation and excavations of limited length) and the consequent purpose of this invention is that of obtaining a method of execution that allows consolidation of the whole length of the tunnel or consolidation for stretches of considerable length, consolidation followed by the corresponding excavation.

According to this invention, this purpose is satisfied, performing the works of consolidation by means of an adequate number of guided peripheral perforations and possibly to the nucleus or in another position of the tunnel being built and later consolidation with the introduction in each perforation of opportune products, commonly known as reinforcements or inserts (metallic, in fibreglass or in other suitable materials) aimed at receiving the consolidation jet at high or low pressure or allowing consolidation using the jet-grouting technology with pressure jets of cement mixtures, gel or resins.

During the works of consolidation works of drainage may also be made, making use of one or more of the guided perforations, obviously covered and left free to discharge the drainage waters.

In the case in which the perforation reaches the other extremity of the work on the tunnel or the excavation, it is possible to replace the perforation bits either with reamers to pull the reinforcements or with nozzles for the treatment of jet-grouting type; and it is also possible to use the perforation rods as jet rods; in case the perforations terminate, instead, in the terrain the jet-grouting equipment will be mounted behind the perforation bits or, just as the inserts, reintroduced in the hole following extraction of the perforation rods also with the use of coatings to prevent the caving in of the hole itself.

Having performed the works of consolidation on the periphery of the tunnel being built, one arranges, after the setting time for the cement mixtures and/or other materials used for the consolidation, to excavate the core of the tunnel for the whole of its length or for relatively long stretches of the same.

After excavation the works of plugging of the bottom and walls are carried out according to known techniques for finishing of the tunnel.

This way of proceeding according to the invention, has considerable executive and economic advantages. The executive advantages are substantially:

- the possibility of knowing the real stratigraphy in continuum for long stretches or for the whole length of the route before intervening with the excavation;
- the possibility, in case of the presence of a water-bearing stratum even under pressure, of realising a series of drainage points around the tunnel before starting the excavation operations;
- the real possibility of maturing the cement or other aggregating substance for the necessary time having separated the intervention times between consolidation and excavation;
- having consolidation in progress, even for many hundreds of metres, with reduction of the risk of deformations and collapses;
- working environment in the open and with the spaces necessary in the cases in which the consolidation may be realised for the entire length of the work;
- better organisation of the personnel both responsible for consolidation and for excavation in that they operate at different times;
- considerable reduction of the interventions of consolidation inside the tunnel when the length of the same or particular situations advise subdividing the consolidation into more stretches.

The economic advantages obtained with the method in question are:

- transportation to the outside of processes that are normally carried out inside tunnels and thus with lower costs for personnel and without the problems of operating with large equipment in small spaces in the hypothesis of treatments for the entire length of the work;
- continuity of the processes both of consolidation and the successive excavation without the current losses of time in changing equipment and personnel between one type of process and the other;
- lack of the current super-imposition of the works of consolidation that means a saving of material;
- the possibility of having a cylindrical excavation cross-section with centering always equal and not saw-toothed as with current excavations, with necessary variable centering;
- saving on the quantity of material to excavate with the cylindrical cross-section;
- saving on the quantity of jetted concrete for coating with the cylindrical cross-section;
- limited nature of the spaces between one movement and the other to perform the single works of consolidation.

BRIEF DESCRIPTION OF THE DRAWINGS

The invention in question is clarified in its practical and exemplary realisations of a tunnel in the attached drawings, where.

DETAILED DESCRIPTION

Figure 1:
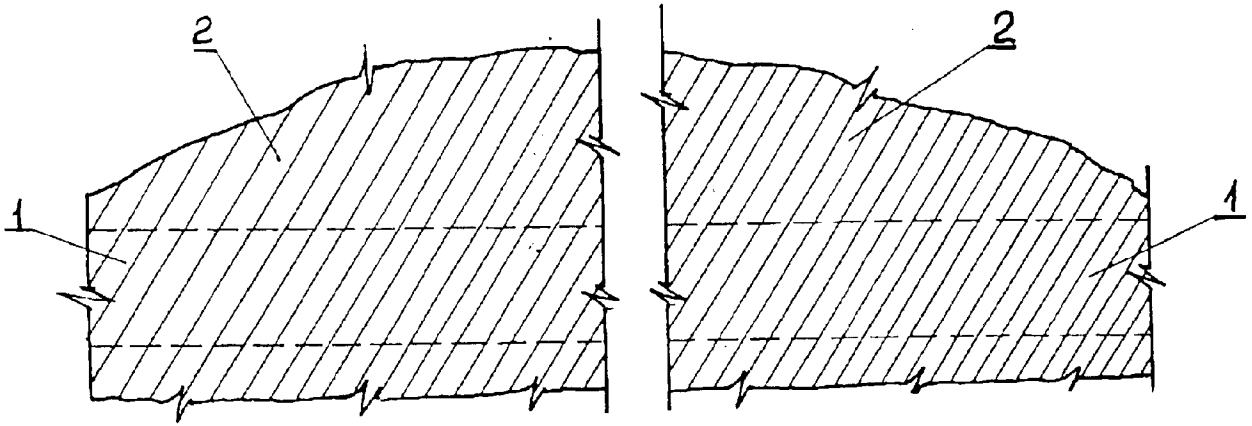
FIG. 1 shows the longitudinal cross-section of a tunnel being built to be carried out with the method according to the invention.

With reference to said figures, with FIG. 1 an example tunnel is indicated to be built that evidently may be of any type and assigned to any civil, industrial or military use. This tunnel 1 can be built in terrain 2 of any nature and shape.

Figure 2:
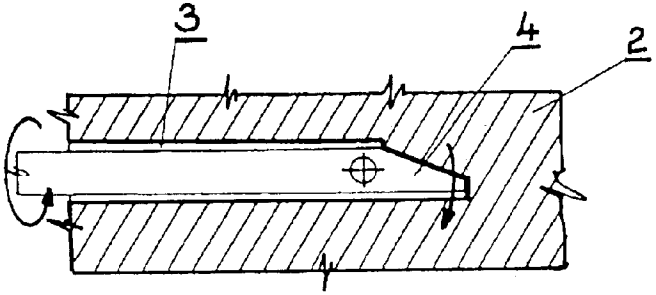
FIG. 2 shows a longitudinal view of known equipment for guided perforation of small diameter for instance with flute shaped swinging head.
Figure 3:
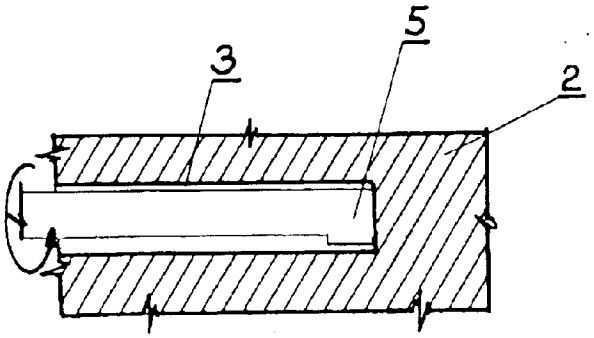
FIG. 3 shows a longitudinal view of known equipment for guided perforation of small diameter for instance with an asymmetrical headed hammer.
Figure 4:
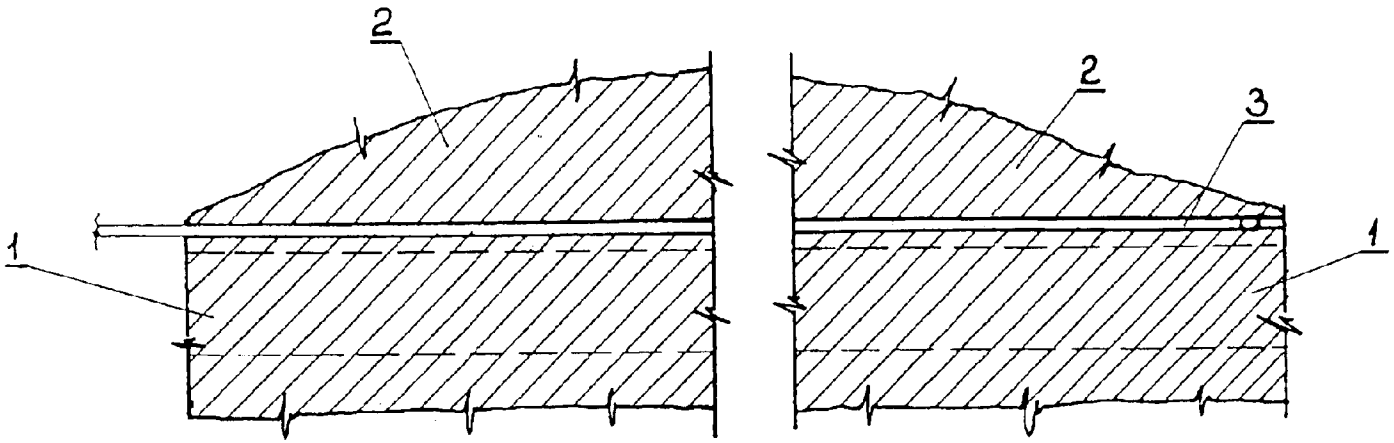
FIG. 4 shows in longitudinal cross-section the tunnel being built with a first guided perforation performed along the total length of the tunnel or part of it.

In FIG. 4 in the upper zone of tunnel 1 a guided perforation 3 is shown as an example, obtained with known equipment for guided perforation of holes of relatively small diameter, fitted with a swinging head for instance flute shaped 4 or with an asymmetrical headed hammer 5 as illustrated indicatively in FIGS. 2 and 3 or with mud turbines or other system.

This guided perforation equipment is constantly monitored and controlled by radio, magnetic, radar, optic or electronic reference systems etc. in such way as to define the precise position of the perforation bit and its orientation. The guided perforation 3 is the first phase of the consolidation operations.

Figure 5:
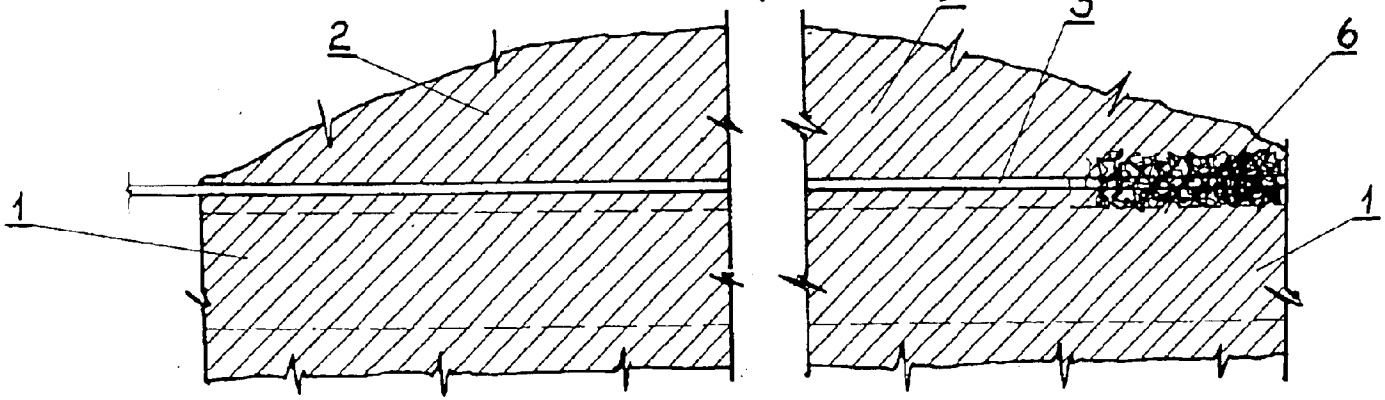
FIG. 5 shows in longitudinal cross-section the guided perforation of FIG. 4 in phase of successive withdrawal of the perforation equipment and contemporary successive consolidation by means of a jet-grouting system or by means of a system with reinforcements.
Figure 6:
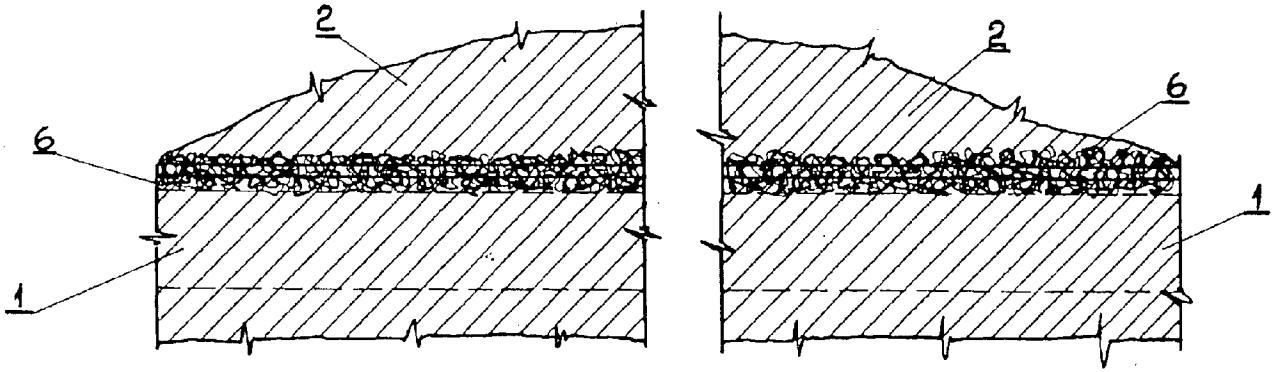
FIG. 6 shows in longitudinal cross-section the total consolidation of the first guided perforation.

In FIG. 5 the second phase of the consolidation operations is shown, with which one creates, step by step during the withdrawal of the guided perforation equipment, consolidation 6 of the perforation 3. This consolidation 6 continues for the entire length of the guided perforation 3, according to FIG. 6 or for successive long stretches of perforation.

Figure 7:
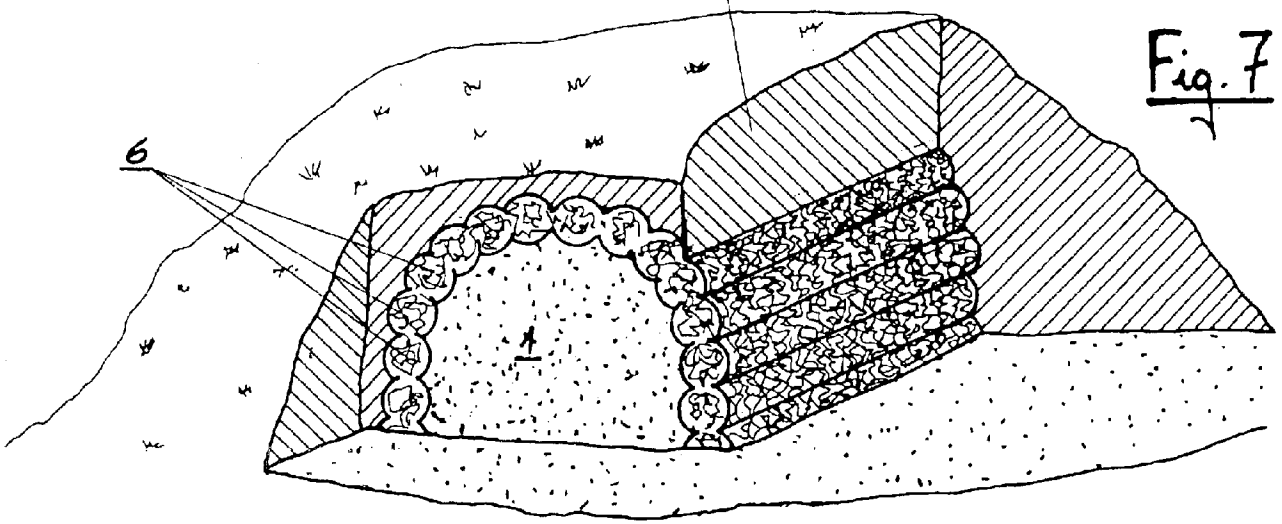
FIG. 7 shows in perspective view the group of consolidations around the tunnel being built with numerous guided perforations arranged as a crown.
Figure 8:
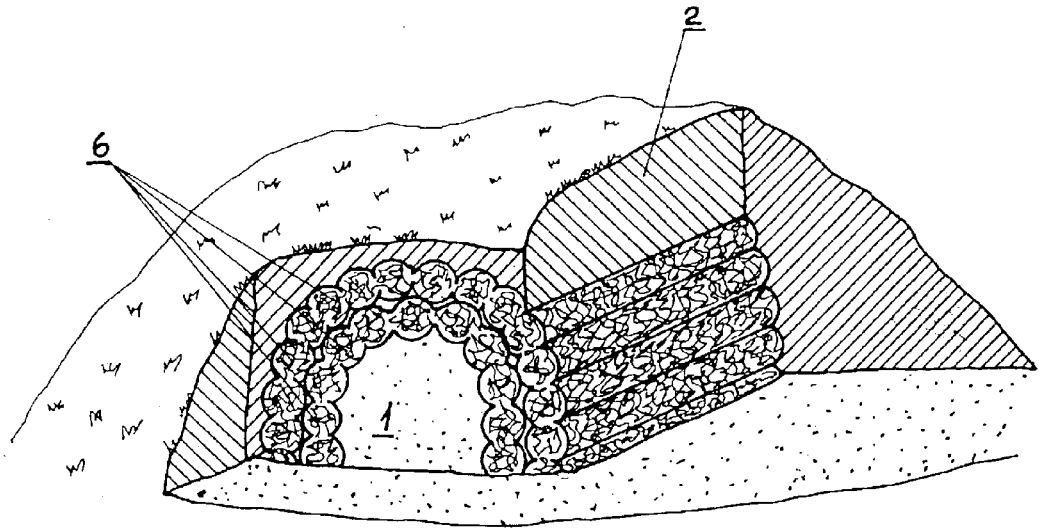
FIG. 8 shows in perspective view the group of consolidations around the tunnel being built with numerous guided perforations arranged as a multiple crown.
Figure 9:
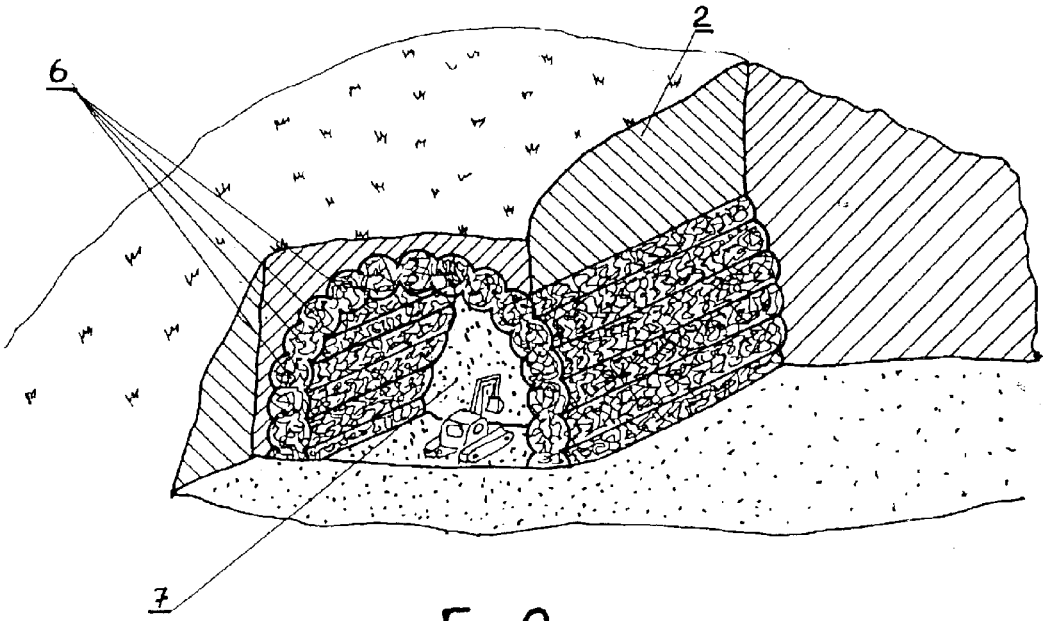
FIG. 9 shows in perspective view the start of the excavations after said consolidation.

The next phase three of the consolidation operations, envisages numerous guided and consolidated peripheral perforations 3 practically with parallel axes, created around the tunnel being built 1 with crown arrangement according to FIG. 7 or with multiple crown arrangement according to FIG. 8.

The next phase four concerns, after setting of the consolidations, start of excavation 7, which takes place along the whole length of the tunnel 1 or for successive long stretches of the same.

The last phase five regards treatment of the finishing of the walls and floor as well as all the successive works inherent with the definitive functional arrangement of the tunnel.

Particular interest is paid in this invention, to phase two of consolidation, which uses the numerous guided perforations 3 as described above, and the works of consolidation that may be made with columnar jet-grouting treatment or by means of systems with reinforcements or still again with the two systems mixed. Furthermore, one or more of the guided perforations 3 may be used for drainage of the tunnel.

Consolidation through columnar jet-grouting treatment envisages, during withdrawal or advancing of the guided perforation equipment 3, injection within the perforation of aggregating substances, such as cement compounds, gel, resins, etc., which on mixing with the terrain create resistant cores along the whole length of the tunnel or part of it.

Instead, consolidation through a reinforcement system envisages, either during the perforation or during withdrawal of the guided perforation equipment 3, the introduction into the perforation of metal or other material inserts and successive injection at low or high pressure, of aggregating materials (cement compounds, resins, etc.). This reinforcement improves the resistance of the internal core 6 that is forming with the expansion of the aggregating products in the terrain adjacent to the guided perforation.

The mentioned systems of jet-grouting consolidation or by means of reinforcements, may also be used one with the other according to the type of excavation to be carried out and the type of tunnel to be created.

In case of use of a guided perforation 3 for drainage of the tunnel, one arranges to replace the excavation head with a bore reamer that drags, during recovery of the rotating tubular rods of the perforation equipment, a metal pipe or one of other suitable material, that is laid inside the excavation with the function of casing for the drainage duct.

The placement of inserts and drainage even after the extraction of the perforation rods from the same part of the start of perforations is envisaged with a simple thrusting of the reinforcements or drainage pipes into the free hole protected in the perforation phase by casing pipes (to be recovered later) that prevent caving in.

It is therefore evident, according to the aims of this invention, that use of the guided perforation system, to carry out the external consolidation of the tunnel before excavation, allows to obtain functional and economic advantages of great value compared to the current consolidation technique with extremely short stretches (15–20 m.) permitting consolidation over the entire length of the tunnel or on a few relatively long stretches of the tunnel itself (stretches of tunnel up to 800 m and more are possible). Even the preparation of tunnels with routes with little cover realisable with consolidation to be obtained with jet-grouting techniques from above (from the surface), according to this invention shows advantages that are evident in that most of the empty perforations before reaching the consolidation zone are eliminated.

The advantage should also be noted that consolidation through guided perforation, according to this invention, allows to obtain a resistant work according to precise static conditions in that guided perforations are traced exactly as in the project, even following curved routes though orientation of the guided perforating heads. The invention is also advantageous for the realisation of consolidation of underground elements, even horizontal, of separation of contiguous terrain with hydraulic and hydro-geological aims, to separate phreatic or artesian surfaces or for the impermeabilisation of lakes, troughs, canals or to restore impermeability to tanks used for discharge. These underground elements may have consolidation works through guided perforations done in simple or multiple series, where each guided perforation receives the aggregating materials by means of a system with inserts or with the jet-grouting system. These consolidation works of the task may be independent of possible excavations or remodelling of the terrain.

What is claimed is:

1. Continuous method of realization of underground works, comprising the steps of:

making a plurality of guided perforations having a large horizontal component around a periphery of an underground work to be realized and extending at least a portion of the length of the underground work to be realized, by perforation equipment with a movable perforation head, and filling each guided perforation with at least one of reinforcements and aggregating materials to consolidate the work with a resistant arrangement according to substantially exact measurements that have to be followed in order to develop the underground structure.

2. Method according to claim 1, wherein said step of making includes the step of making the plurality of guided perforations in one of:

a) a single crown arrangement, and b) a multiple crown arrangement.

3. Method according to claim 1, wherein said step of filling includes a step of introducing aggregating materials into each guided perforation, according to a jet-grouting system.

4. Method according to claim 1, wherein the step of filling includes the step of filling the guided perforations with both said reinforcements and said aggregating materials.

5. Method according to claim 1, wherein the aggregating materials and reinforcements expand and pack down in terrain surrounding the guided perforations, creating resistant cores close to one another, which resistant cores one of:

a) penetrate each other, and b) are separate from each other.

6. Method according to claim 1, wherein with advancement of the perforation equipment during the step of making of each guided perforation, further comprising the step of introducing into the guided perforation at least one of the reinforcements and aggregating means.

7. Method according to claim 1, wherein during making of each guided perforation, further comprising the step of introducing the aggregating materials according to a jet-grouting system.

8. Method according to claim 1, wherein said underground work is one of:

a) a tunnel, b) a separation structure between contiguous terrains for hydraulic and hydra-geological uses, c) a separation structure for separating phreatic or artesian surfaces, d) a structure for impermeabilization and consolidation of troughs, lakes and discharge tanks.

9. Method according to claim 1, wherein said step of making includes the step of making said plurality of guided perforations for an entire length of the underground tunnel to be realized, by said perforation equipment.

10. Method according to claim 1, wherein each said reinforcement is formed by an insert.

11. Method according to claim 1, wherein said aggregating materials include a material selected from the group consisting of cement mixtures, gels and resins.

12. Method according to claim 1, wherein said step of filling includes the step of injecting said aggregating materials into the guided perforations under pressure.

13. Method according to claim 1, further comprising the step of excavating the work within said filled perforations to form an underground tunnel.

14. Continuous method of realization of underground works, comprising the steps of:

making a plurality of guided perforations around a periphery of an underground work to be realized and extending at least a portion of the length of the underground work to be realized, by perforation equipment with a movable perforation head, filling each guided perforation with at least one of reinforcements and aggregating materials to consolidate the work with a resistant arrangement according to substantially exact measurements that have to be followed in order to develop the underground structure, withdrawing the perforation equipment after making each guided perforation, and wherein said step of filling includes the step of introducing at least one of the reinforcements and aggregating materials into each perforation with withdrawal of the perforation equipment therefrom.

15. Continuous method of realization of underground works, comprising the steps of:

making a plurality of guided perforations around a periphery of an underground work to be realized and extending at least a portion of the length of the underground work to be realized, by perforation equipment with a movable perforation head, filling each guided perforation with at least one of reinforcements and aggregating materials to consolidate the work with a resistant arrangement according to substantially exact measurements that have to be followed in order to develop the underground structure, making at least one additional guided perforation around a periphery of the underground work to be realized and extending at least a portion of the length of the underground work to be realized, by perforation equipment including a perforation hole reamer, dragging, during recovery of tubular rotating rods of the perforation equipment, a metallic pipe that is placed within the additional guided perforation for the purpose of providing a drainage pipe for use in drainage of the work.

16. Continuous method of realization of underground works, comprising the steps of:

making a plurality of guided perforations around a periphery of an underground work to be realized and extending at least a portion of the length of the underground work to be realized, by perforation equipment with a movable perforation head, each perforation having a length of at least approximately 800 meters, and filling each guided perforation with at least one of reinforcements and aggregating materials to consolidate the work with a resistant arrangement according to substantially exact measurements that have to be followed in order to develop the underground structure.

* * * * *